US005984205A

United States Patent [19]

Rosenberg

[11] Patent Number: 5,984,205

[45] Date of Patent: Nov. 16, 1999

[54] BALL-DRIVEN ROTARY WATER SPRINKLER

[76] Inventor: Peretz Rosenberg, Moshav Beit Shearim, 30 046 Doar Na Haamakim, Israel

[21] Appl. No.: 08/899,810

[22] Filed: Jul. 24, 1997

[30] Foreign Application Priority Data

Aug. 14, 1996 [IL] Israel ..... 119073

[51] Int. Cl.[6] ..... B05B 3/04; B05B 3/08

[52] U.S. Cl. ..... 239/233; 239/240

[58] Field of Search ..... 239/240, 230, 239/231, 233, 251

[56] References Cited

U.S. PATENT DOCUMENTS 3,131,867 5/1964 Miller et al. ..... 239/240 X 3,334,817 8/1967 Miller et al. .

4,784,325 11/1988 Walker et al. .

4,944,456 7/1990 Zakai .

*Primary Examiner*—Andres Kashnikow

*Assistant Examiner*—Sean P. O'Hanlon

*Attorney, Agent, or Firm*—Benjamin J. Barish

[57] ABSTRACT

A rotary sprinkler includes a drive assembly having a rotary drive rotated by the inletted pressurized water, a rotor, a mechanical coupling between the rotary drive and the rotor, and at least one ball carried by the rotor and movable radially outwardly thereof by centrifugal force during the rotation of the rotor; and a water discharge assembly rotatably carried by the sprinkler housing and including a water discharge outlet fluidly coupled to the sprinkler inlet, and an abutment located to be impacted by the ball when in its radial outward position during the rotation of the rotor to thereby rotate the water discharge assembly in a series of stepped increments.

18 Claims, 1 Drawing Sheet

BALL-DRIVEN ROTARY WATER SPRINKLER

FIELD AND BACKGROUND OF THE INVENTION

The present invention relates to rotary sprinklers, and particularly to the ball-type rotary sprinkler in which the sprinkler is rotated in a series of stepped increments by impacting a ball against an abutment carried by the sprinkler.

The conventional ball-type rotary sprinkler includes a swirl chamber containing at least one ball which is driven around the chamber by the water flowing from the sprinkler inlet to the sprinkler outlet to produce the impacts rotating the sprinkler. Since, in such a sprinkler, the ball is in the flow path of the water, the ball imposes a resistance to the flow of the water through the sprinkler; moreover, dirt within the water may settle in the swirl chamber and/or on the ball, thereby making the sprinkler susceptible to jamming.

OBJECTS AND BRIEF SUMMARY OF THE INVENTION

An object of the present invention is to provide a ball-type rotary sprinkler of a novel construction having advantages over the conventional ball-type sprinkler in the above respects. Another object of the present invention is to provide a rotary sprinkler of a simple and compact construction requiring relatively few simple parts which can be produced and assembled in volume and at low cost.

According to the present invention, there is provided a rotary sprinkler comprising a housing having an inlet connectable to a water supply pipe supplying pressurized water; a drive assembly carried by the housing and including a rotary drive rotated by the pressurized water, a rotor, a mechanical coupling between the rotary drive and the rotor, and at least one ball carried by the rotor and movable radially outwardly thereof by centrifugal force during the rotation of the rotor; and a water discharge assembly rotatably carried by the housing and including a water discharge outlet fluidly coupled to the inlet, and an abutment located to be impacted by the ball when in its radial outward position during the rotation of the rotor to thereby rotate the water discharge assembly in a series of stepped increments during the rotation of the rotor. The rotary drive is located adjacent the inlet at one end of the water discharge assembly, and the rotor, including the at least one ball carried thereby, is located at the opposite end of the water discharge assembly.

According to further preferred features of the invention as included in the preferred embodiment described below, the rotary drive is a water turbine rotated by the pressurized water flowing through the inlet. In the preferred embodiment, the water turbine is located adjacent the inlet at one end of the water discharge assembly, the rotor is located at the opposite end of the water discharge assembly, and the mechanical coupling between the water turbine and the rotor includes a coupling rod passing through the water discharge assembly.

It will thus be seen that, in a rotary sprinkler constructed in accordance with the foregoing features, the water flowing through the sprinkler from its inlet to its outlet does not pass through a swirl chamber, or come into contact with the ball (or balls) producing the stepped rotation of the sprinkler, and therefore such ball does not impose a resistance to the flow of the water through the sprinkler. Moreover, such a sprinkler is less sensistive to jamming by dirt within the supply water since the supply water does not pass through a swirl chamber and does not come into direct contact with the ball or balls producing the stepped rotation of the sprinkler. Further, such a sprinkler requires but a few simple parts which can be produced and assembled in volume and at low cost.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF A PREFERRED EMBODIMENT

Figure 1:
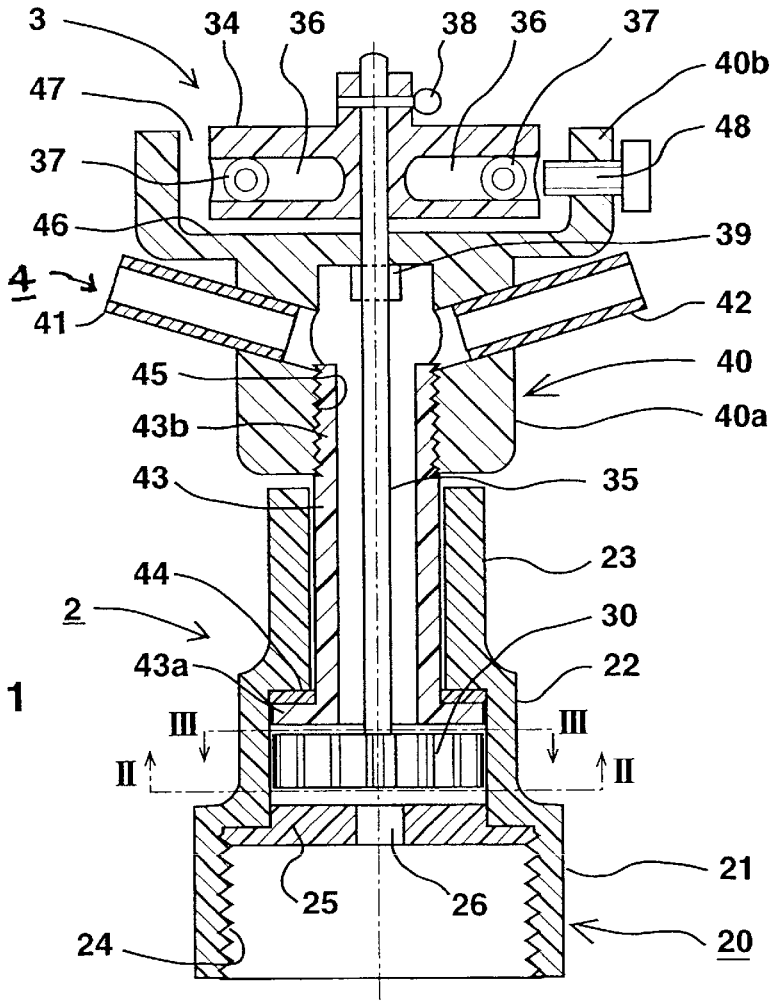
FIG. 1 is a longitudinal sectional view illustrating one form of rotary sprinkler constructed in accordance with the present invention.

The rotary sprinkler illustrated in the drawings comprises three main assemblies: a mounting assembly, generally designated 2; a rotary drive assembly, generally designated 3; and a rotary water discharge assembly, generally designated 4. The mounting assembly 2 is fixedly mounted to a source of pressurized water, e.g. a vertical riser pipe (not shown). The rotary drive assembly 3 receives the pressurized water inletted into the sprinkler and is rotated at a relatively high speed by the water flowing through the sprinkler. The rotary water discharge assembly 4, which discharges the water lateraly of the sprinkler, is rotated at a relatively lower speed, and in stepped increments, by the rotary drive assembly 3.

More particularly, the mounting assembly 2 includes a cylindrical housing 20 formed with a large-diameter section 21, an intermediate-diameter section 22, and a small-diameter section 23. The large diameter section 21 is formed with internal threads 24 for threaded attachment to the water supply pipe, e.g. a vertical riser pipe (not shown). A disc 25 is provided at the juncture of the two sections 21, 22, and is formed with a central opening 26 serving as an inlet for inletting the water into the interior of the intermediate housing section 22.

Figure 2:
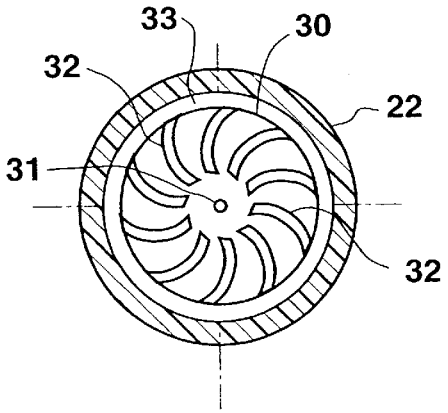
FIG. 2 is a transverse sectional view along line II—II of FIG. 1.
Figure 3:
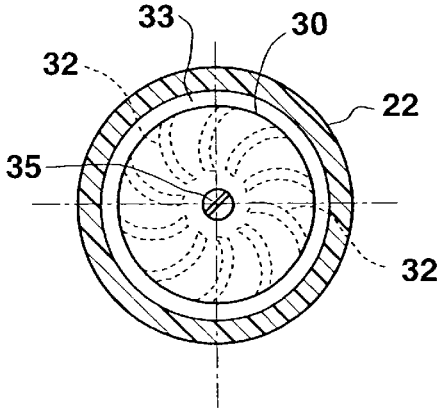
FIG. 3 is a sectional view along line III—III of FIG. 1.

The rotary drive assembly 3 includes a rotary drive in the form of a water turbine 30 which is rotated by the pressurized water inletted via inlet opening 26. As shown in FIG. 2, water turbine 30 includes a central disc 31 aligned with the inlet opening 26 so as to deflect the inletted water outwardly of the turbine to impinge against a plurality of vanes 32, and thereby to rotate the turbine at a relatively high speed by the inletted water. The outer diameter of the water turbine 30 is less than the inner diameter of the intermediate housing section 22, to define an annular passageway 33 for the water in its flow to the rotary water discharge assembly 4.

The rotary drive assembly 3 further includes a rotor 34 at the opposite end of the water discharge assembly 4 and mechanically coupled to the water turbine 30 by a coupling rod 35 passing through the sprinkler. Rotor 34 is formed with a pair of diametrically-aligned radially-extending cavities 36 each occupied by a ball 37 rotatable within its respective cavity.

Rotor 34 is fixed to coupling rod 35 by a pin 38 so that the rotor rotates with the coupling rod. Coupling rod 35 further includes an abutment 39 engageable with an inner surface of the rotary water discharge assembly 4 to limit the outward movement of the coupling rod 35, including the water turbine 30 at one end and the rotor 34 at the opposite end, during the operation of the sprinkler.

Since rotor 34 is mechanically coupled by rod 35 to the water turbine 30, the rotor will be rotated by the inletted water at the same relatively high rotational speed as the water turbine. This high speed rotation of rotor 34 drives its balls 37 outwardly of their respective cavities 36, to effect the lower-speed, stepped-rotation of the water discharge assembly 4.

Thus the rotary water discharge assembly 4 includes a rotary head 40 mounting a pair of diametrically-aligned nozzles 41, 42. Head 40 is rotatably mounted to housing 20 by a hollow sleeve 43. One end of hollow sleeve 43 is formed with an out-turned annular flange 43*a* received within housing section 22 between the water turbine 30 and the shoulder at the juncture between housing sections 22 and 23. A sealing bearing ring 44 is interposed between flange 43*a* and the juncture between the two housing sections 22, 23. The opposite end 43*b* of hollow sleeve 43 is frictionally received within the respective end of the rotary head 40.

Rotary head 40 is constituted of an inner smaller-diameter section 40*a*, and an outer larger-diameter section 40*b*. The inner smaller-diameter section 40*a* carries the two nozzles 41, 42. It is formed with a cavity 45 for frictionally receiving the end 43*b* of the hollow sleeve 43 to thereby define a water flow passageway through the interior of the hollow sleeve, in the space between its inner surface and the coupling rod 35, to the nozzles 41, 42.

The outer larger-diameter section 40*b* of the rotary head 40 includes a transversely-extending wall 46 which closes the passageway through hollow sleeve 43, thereby directing the water to flow through the outlet nozzles 41, 42. The outer larger-diameter section 40*b* of rotary head 40 is formed with a second cavity 47 for receiving the high-speed rotor 34 coupled to the water turbine 30 of the rotary drive assembly 3. Cavity 47 is of cylindrical configuration but of larger inner diameter than the outer diameter of rotor 34, so that the rotor 34 is freely rotatable within this cavity.

Section 40*b* of the rotary head 40 further includes a radially-extended threaded pin 48 which is threaded into cavity 47 so as to be impacted by the balls 37 during the rotation of rotor 34.

OPERATION

The operation of the rotary sprinkler illustrated in the drawings will be apparent from the above description. Thus, the water inletted via inlet opening 26 drives the water turbine 30 at a relatively high speed as the water flows from inlet 26 to the two nozzles 41, 42 via a flow path including the annular space 33 around the turbine and the interior of the hollow sleeve 43.

The high speed rotation of turbine 30 is transmitted by coupling rod 35 to rotor 34 at the outer end of the sprinkler. This high speed rotation of rotary 34 causes its balls 37 to move outwardly, by centrifugal force, and thereby to impact against the inner end of the threaded fastener 48. These repeated impacts of the threaded fastener 48 by balls 37 thus rotate rotary head 40, including its pair of nozzles 41, 42, in short steps or increments as the nozzles discharge the water lateraly of the sprinkler.

It will thus be seen that the water flowing from the inlet 26 to the nozzles 41, 42 does not come into contact with the balls 37 which produce the stepped rotation of the sprinkler. Accordingly, the balls do not impose a resistance to the flow of the water to the discharge nozzles 41, 42. In addition, dirt particles within the water do not come into contact with the balls producing the stepped rotation, or the cavities within which the balls move, and therefore there is less possibility that dirt particles within the water will tend to jam the rotation of the sprinkler. Further, the rotary speed of the sprinkler can easily be changed by substituting another rotor 34, having an impacting ball (or balls) 37, of the appropriate design for the desired speed.

While the invention has been described with respect to one preferred embodiment, it will be appreciated that this is set forth merely for purposes of example, and that many changes may be made. For example, the illustrated sprinkler could include but a single nozzle, or simple water discharge openings instead of nozzles. In addition, the rotor 34 could be provided with but a single cavity 36 and a single ball 37, or a plurality of pairs of such cavities and balls spaced around its circumference.

Many other variations, modifications and applications of the invention will be apparent.

I claim:

1. A rotary sprinkler, comprising:

a housing having an inlet connectable to a water supply pipe supplying pressurized water;

a drive assembly carried by said housing and including a rotary drive rotated by the pressurized water, a rotor, a mechanical coupling between said rotary drive and said rotor, and at least one ball carried by said rotor and movable radially outwardly thereof by centrifugal force during the rotation of the rotor;

and a water discharge assembly rotatably carried by said housing and including a water discharge outlet fluidly coupled to said inlet, and an abutment located to be impacted by said ball when in its radial outward position during the rotation of said rotor, to thereby rotate the water discharge assembly in a series of stepped increments during the rotation of said rotor;

said rotary drive being located adjacent said inlet at one end of the water discharge assembly;

said rotor, including said at least one ball carried thereby, being located at the opposite end of the water discharge assembly.

2. The rotary according to claim 1, wherein said rotary drive is a water turbine rotated by the pressurized water flowing through said inlet.

3. The rotary sprinkler according to claim 2, wherein said mechanical coupling between said water turbine and said rotor includes a coupling rod passing through said water discharge assembly.

4. The rotary sprinkler according to claim 3, wherein said rotor is rotatably mounted within a cavity in said opposite end of the water discharge assembly, said abutment being located within said cavity.

5. The rotary sprinkler according to claim 1, wherein said rotor is formed with a pair of diametrically aligned cavities each receiving one of said balls.

6. The rotary sprinkler according to claim 1, wherein said water discharge assembly comprises a rotary head having an inner end carrying said water discharge outlet, and an outer end carrying said abutment.

7. The rotary sprinkler according to claim 6, wherein said water discharge assembly further comprises a hollow stem having one end fixed to said rotary head, and the opposite end rotatably mounted to said housing and in fluid communication with said inlet.

8. The rotary sprinkler according to claim 7, wherein said rotary head is formed with a first cavity defining a water flow path from said hollow stem to said water discharge outlet, a second cavity for receiving said rotor of the drive assembly, and a separation wall between said first and second cavities, said mechanical coupling between the rotary drive and rotor passing through said separation wall.

9. The rotary sprinkler according to claim 8, wherein said rotor is fixed to said mechanical coupling, and said mechanical coupling includes an abutment engageable with said separation wall to limit the position of said rotor.

10. The rotary sprinkler according to claim 1, wherein said water discharge outlet in the water discharge assembly includes a pair of diametrically-opposed nozzles for discharging the water lateraly of the sprinkler in the form of water jets.

11. A rotary sprinkler, comprising:

a housing having an inlet connectable to a water supply pipe supplying pressurized water;

a drive assembly carried by said housing and including a water turbine rotated by the pressurized water, a rotor, a mechanical coupling between said water turbine and said rotor, and at least one ball carried by said rotor and movable radially outwardly thereof by centrifugal force during the rotation of the rotor;

and a water discharge assembly rotatably carried by said housing and including a rotary head, a water discharge outlet carried by one part of the rotary head and fluidly coupled to said inlet, and an abutment carried by another part of the rotary head and located to be impacted by said ball when in its radial outward position during the rotation of said rotor, to thereby rotate the water discharge assembly in a series of stepped increments during the rotation of said rotor;

said water turbine being located adjacent said inlet at one end of the water discharge assembly;

said rotor, including said at least one ball carried thereby being located at the opposite end of the water discharge assembly.

12. The rotary sprinkler according to claim 11, wherein said mechanical coupling between said water turbine and said rotor includes a coupling rod passing through said water discharge assembly.

13. The rotary sprinkler according to claim 12, wherein said rotor is rotatably mounted within a cavity in said opposite end of the water discharge assembly, said abutment being a pin projecting into said cavity.

14. The rotary sprinkler according to claim 13, wherein said rotor is formed with a pair of diametrically aligned cavities each receiving one of said balls.

15. The rotary sprinkler according to claim 11, wherein said water discharge assembly further comprises a hollow stem having one end fixed to said rotary head, and the opposite end rotatably mounted to said housing and in fluid communication with said inlet.

16. The rotary sprinkler according to claim 15, wherein said rotary head is formed with a first cavity defining a water flow path from said hollow stem to said water discharge outlet, a second cavity for receiving said rotor of the drive assembly, and a separation wall between said first and second cavities, said mechanical coupling between the water turbine and rotor passing through said separation wall.

17. The rotary sprinkler according to claim 16, wherein said rotor is fixed to said mechanical coupling, and said mechanical coupling includes an abutment engageable with said separation wall to limit the position of said rotor.

18. The rotary sprinkler according to claim 11, wherein said water discharge outlet in the water discharge assembly includes a pair of diametrically-opposed nozzles for discharging the water lateraly of the sprinkler in the form of water jets.

* * * * *